US007950178B1

(12) United States Patent
Landies et al.

(10) Patent No.: US 7,950,178 B1
(45) Date of Patent: May 31, 2011

(54) RIFLE STRIKING MECHANISM FOR SEMI-AUTOMATIC OPERATION

(75) Inventors: Robert I. Landies, Chardon, OH (US); Daniel L. Albright, Chardon, OH (US); Joshua G. Hershberger, Concord Township, OH (US)

(73) Assignee: Ohio Ordnance Works, Inc., Chardon, OH (US)

( * ) Notice: Subject to any disclaimer, the term of this patent is extended or adjusted under 35 U.S.C. 154(b) by 304 days.

(21) Appl. No.: 12/411,026

(22) Filed: Mar. 25, 2009

(51) Int. Cl.
*F41A 19/00* (2006.01)

(52) U.S. Cl. ..... 42/69.01; 89/128; 89/139; 42/69.02

(58) Field of Classification Search ..... 42/69.01–69.03; 89/128, 139, 189
See application file for complete search history.

(56) References Cited

U.S. PATENT DOCUMENTS 3,386,336 A * 6/1968 Roy ..... 89/128
4,891,898 A * 1/1990 Houseman ..... 42/69.02
5,614,691 A * 3/1997 Taylor ..... 89/128
5,663,522 A * 9/1997 Kuehl ..... 89/128
6,634,129 B1 * 10/2003 Freeman, Jr. ..... 42/69.02
7,676,974 B2 * 3/2010 Zemanek ..... 42/69.02
2007/0266845 A1 * 11/2007 Polston ..... 89/139
2008/0216375 A1 * 9/2008 Barrett ..... 42/16
2010/0180760 A1 * 7/2010 Polston ..... 89/139
* cited by examiner

*Primary Examiner* — Bret Hayes
*Assistant Examiner* — Joshua Freeman
(74) *Attorney, Agent, or Firm* — Renner, Kenner, Greive, Bobak, Taylor & Weber

(57) ABSTRACT

A striking mechanism for the semi-automatic operation of a cartridge firing firearm includes a receiver, a barrel attached to the receiver and providing a breach, an op rod assembly, and a bolt adapted for reciprocating movement within the receiver and engagable with the breach of the barrel and the face of a cartridge chambered therein. The bolt carries a primary firing pin, and a bolt lock means is pivotally connected to the bolt for selectively locking the bolt within the receiver. A bolt link assembly is pivotally connected to the bolt lock means and to the op rod assembly. The bolt link assembly provides a bolt link transfer pin. An op rod transfer pin is carried by the op rod assembly and can engage the bolt link transfer pin. A linear hammer can engage the op rod transfer pin such that, when a cartridge is chambered and the primary firing pin, the bolt link transfer pin and the op rod transfer pin are in alignment, the force of the linear hammer engaging the op rod transfer pin is transferred through the op rod transfer pin, the bolt link transfer pin and the primary firing pin to strike the primer of a cartridge chambered within the barrel. The striking mechanism is incorporated into prior art fully-automatic firearms to convert them to semi-automatic operation, and methods for such conversion are included.

10 Claims, 8 Drawing Sheets

RIFLE STRIKING MECHANISM FOR SEMI-AUTOMATIC OPERATION

FIELD OF THE INVENTION

This invention relates to a striking mechanism for rifles that provides a semi-automatic operation whereby a single cartridge is fired with each pull of the trigger. More particularly the striking mechanism has been designed and adapted for use in an originally fully automatic firearm. The striking mechanism of the present invention is only capable of semi-automatic operation and has been designed to inhibit conversion of the firearm back to fully automatic operation. Methods for the conversion of cartridge firing firearms from fully automatic operation to semi-automatic operation are also provided. Additionally the present invention provides an assembly for the semi-automatic operation of a cartridge firing firearm.

BACKGROUND OF THE INVENTION

There has always been interest in collecting and shooting weapons that have been developed for and used by the military, both handguns and rifles. This interest is held by many civilians, particularly those who served in the military. Because many of the firearms are capable of fully automatic fire, private ownership is both a right and a privilege and is available to qualified, law-abiding individuals who, in accordance with federal law, acquire a Class II or III Firearms Dealer license or those individuals who apply for and obtain the requisite permission from the local authority where they reside and the Bureau of Alcohol, Tobacco, Firearms and Explosives (BATFE) to become the registered owner of a NFA (National Firearms Act) firearm.

Semi-automatic firearms, on the other hand, are not subject to as rigorous a procedure to own and fire legally and in fact, can currently be legally transferred between individuals. While there is a good selection of handguns and rifles capable of semi-automatic operation, including some "civilian" versions of military firearms, original fully automatic firearms are not readily available in semi-automatic versions. The reasons are numerous including cost of the original firearm, costs to convert it, the necessity for a gunsmith or armorer to perform the work and, the realization on the part of one who has legally acquired such a firearm that the value is often seriously diminished by conversion to semiautomatic operation. Notwithstanding the foregoing reasons, there is a desire for original firearms that have been legally converted to semi-automatic operation and are thus, more readily acquired.

This invention involves the conversion of an M240 automatic rifle to semi-automatic fire. The M240 is a gas operated, air cooled automatic firearm. Expanding gases from the ignition of powder in the cartridge furnishes the energy for the operation or cycling of the rifle. Immediately after firing, as the bullet traverses the barrel and passes an internal gas port prior to exiting from the muzzle, the live gases expand through the gas port into the gas tube or cylinder to impinge against the head of a piston. In so doing, the piston within the gas cylinder is forced rearwardly, toward the buttstock, driving an operation rod assembly (herein "op rod assembly") which cycles a combination of internal components while compressing a recoil spring that effects the return movement.

The op rod assembly carries the firing pin and a bolt link pivotally secures the op rod to the bolt lock. As the op rod assembly begins to travel rearwardly under the influence of the expanding gases resulting from the firing of a cartridge, the bolt link rotates and pulls the bolt lock up out of its cradle in the receiver, thereby unlocking the bolt from the receiver. Once free from the mating receiver surfaces, the bolt travels rearwardly with the bolt link and op rod assembly as it continues its rearward travel. In so doing, several additional operations continue. Cartridges for the M240 are belt fed, and the bolt carries a roller that engages a feed lever to feed cartridges into the receiver in a known manner, during this rearward travel. The op rod assembly contacts a buffer in the buttstock, halting its rearward movement, and immediately begins return travel in response to the compression of the recoil spring. Continued forward movement is then a function of the position of the trigger.

Assuming the trigger remains depressed, it will not engage the sear ledge on the underside of the op rod assembly and thus the op rod assembly will continue forward under the influence of the recoil spring. During the forward movement, the bolt strips a cartridge from the belt for chambering. Because they are associated with the op rod assembly, the bolt, bolt lock and bolt link also move forward until the very last increment of movement. The bolt moves until the cartridge is seated, which limits the forward movement of the bolt so that the bolt link is caused to rotate downward, lowering the bolt lock into locking engagement with the receiver, at which stage, the bolt cannot move rearwardly. Directly thereafter, the firing pin carried by the op rod assembly is forced to strike the primer of the chambered cartridge, thereby firing it whereby the above firing sequence is repeated in response to sustained depression of the trigger or until the ammunition is exhausted.

Repeat of this cycle is dependent upon the trigger remaining in the fired position. If the operator releases the trigger, the sear is immediately raised into the path of the sear ledge on the reciprocating op rod assembly. In rearward travel, the op rod assembly can push the sear down to pass over it. However, upon the return, the sear is raised by a spring and engages the sear ledge, halting continued forward movement of the op rod assembly. When this occurs, the action remains opened, and no new round is loaded. Accordingly, the M240 rifle is one which fires from the open bolt and, as soon as the trigger is again pulled, the sear is pulled out of engagement with the sear ledge, allowing the op rod assembly to move forward causing all of the foregoing operations. The bolt closes, taking with it a fresh round from the belt, which is simultaneously chambered and instantaneously thereafter fired, as the foregoing sequence is allowed to repeat.

Basically, the art has not provided a facile means or device by which the M240 can be essentially permanently converted to semi-automatic only operation. Accordingly, there is a need for a striking mechanism that is capable of rendering the M240 rifle a semi-automatic firearm. Moreover, to comply with the existing federal laws, such a firearm must meet BATFE approval which is given where the Bureau determines that the firearm is not readily converted back to fully automatic operation.

SUMMARY OF THE INVENTION

In general, this invention provides a striking mechanism for the semi-automatic operation of a cartridge firing firearm. The striking mechanism includes a receiver, a barrel attached to the receiver and providing a breach, an op rod assembly, and a bolt adapted for reciprocating movement within the receiver and engagable with the breach of the barrel and the face of a cartridge chambered therein. The bolt carries a primary firing pin, and a bolt lock means is pivotally connected to the bolt for selectively locking the bolt within the receiver. A bolt link assembly is pivotally connected to the bolt lock means and to the op rod assembly. The bolt link assembly provides a bolt link transfer pin. An op rod transfer pin is carried by the op rod assembly and can engage the bolt link transfer pin. A linear hammer can engage the op rod transfer pin such that, when a cartridge is chambered and the primary firing pin, the bolt link transfer pin and the op rod transfer pin are in alignment, the force of the linear hammer engaging the op rod transfer pin is transferred through the op rod transfer pin, the bolt link transfer pin and the primary firing pin to strike the primer of a cartridge chambered within the barrel.

The present invention also includes a method for converting a cartridge firing firearm from fully automatic operation to semi-automatic operation, wherein the cartridge firing firearm of fully automatic operation provides a receiver; a barrel attached to the receiver, the barrel providing a breach; a bolt reciprocable within the receiver, the bolt being engageable with the breach of the barrel and the face of a cartridge chambered therein; a bolt lock pivotally connected to the bolt for selectively locking the bolt within the receiver, and an op rod assembly movable within the receiver and providing a sear ledge and carrying a firing pin, a bolt link pivotally connected to the bolt lock and to the op rod assembly and permitting passage of the firing pin through the bolt link; and a trigger assembly including a sear engagable with the sear ledge on the op rod assembly. The method for converting comprises replacing the bolt with a converted bolt providing a primary firing pin; replacing the bolt link with a converted bolt link providing a bolt link transfer pin; replacing the op rod assembly with a converted op rod assembly having no sear ledge for interaction with the sear, the converted op rod assembly providing an op rod transfer pin; and providing a linear hammer having a sear ledge for interaction with the sear of the trigger assembly, the linear hammer being urged toward the op rod assembly by a hammer spring.

DETAILED DESCRIPTION OF ILLUSTRATIVE EMBODIMENTS

The striking mechanism according to the present invention has been adopted for use in a formerly fully automatic rifle, and is provided to cause the rifle to operate as a semi-automatic firearm. The striking mechanism herein is shown used in what was formerly a fully automatic M240 Rifle, though it will be appreciated that the striking mechanism could have further applications elsewhere, and this invention is not limited to or by use in an M240 Rifle. Fully automatic fire, or true "automatic" occurs when the trigger of the firearm is pulled or depressed without release and a plurality of cartridges are continuously cycled through the rifle, each being fired in succession until either the trigger is released or the supply of cartridges has been exhausted. As soon as the trigger is released, firing ceases; when it is again depressed automatic firing re-commences, assuming a remaining supply of cartridges. Semi-automatic fire is that operation that fires only a single cartridge or round every time the trigger is depressed, whether the trigger is held depressed or released. Once the trigger is released, components of the striking mechanism are re-aligned for the next "pull" of the trigger, whereupon another cartridge is fired.

Figure 1:
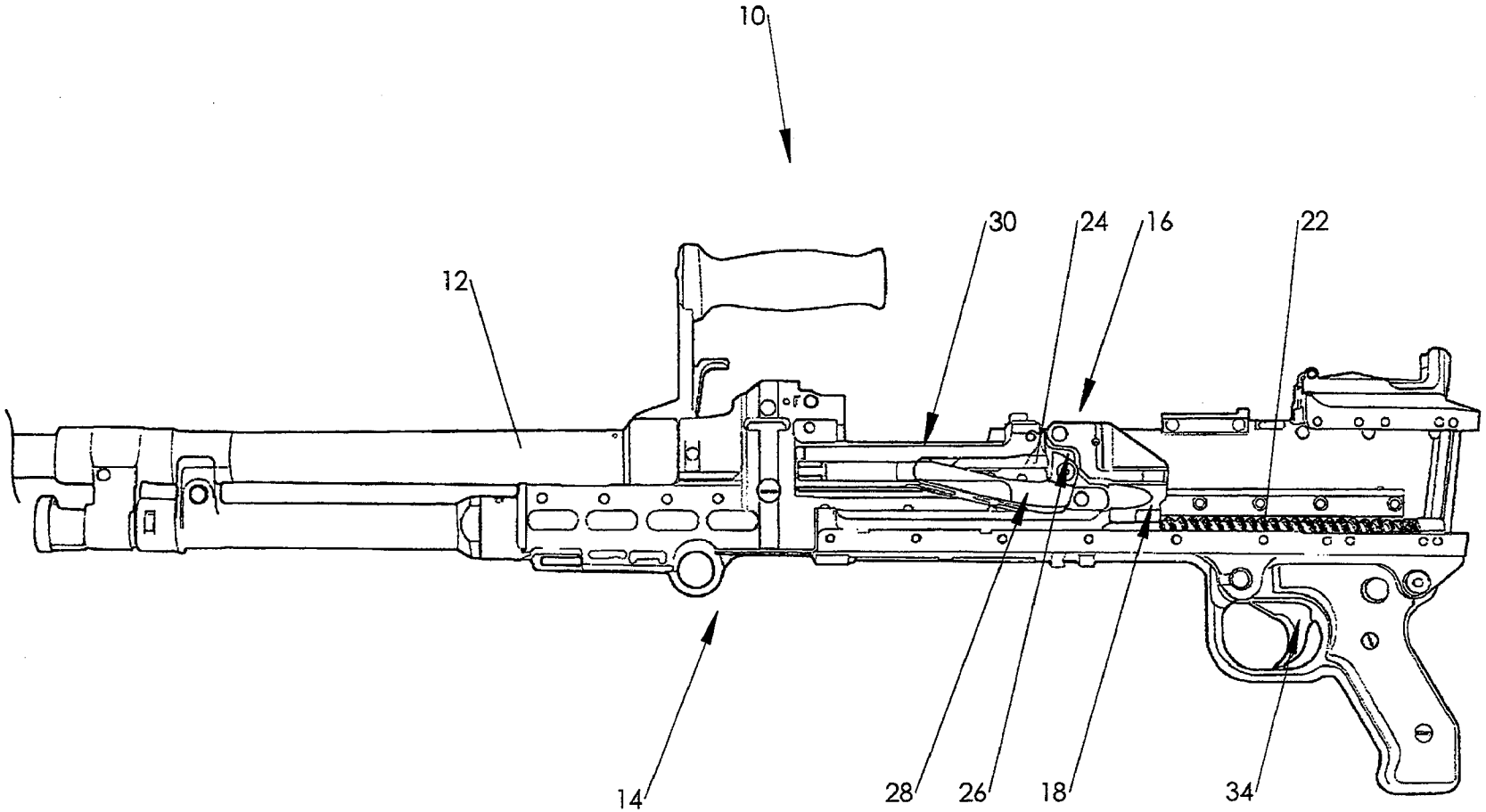
Fig. 1 Prior Art
FIG. 1 is a side elevation view in partial cross section showing a portion of a prior art rifle, particularly an M240 fully automatic rifle, which is to be modified for semi-automatic fire in accordance with a particular embodiment of this invention.

The striking mechanism of the present invention has been specifically designed and reduced to practice for use in an automatic rifle as a replacement for the original striking mechanism that produced fully automatic fire. One such rifle in particular is the M240 Automatic Rifle, Caliber 7.62×51 mm, including the known model variations. A portion of such a rifle is depicted in FIG. 1 and is indicated generally by the numeral 10. The rifle 10 includes a barrel 12, threadably carried by a receiver 14. The receiver houses a striking mechanism 16. The striking mechanism 16 includes a gas operated op rod assembly, indicated generally by the numeral 18, which reciprocates in a gas cylinder beneath the barrel 12. The gas cylinder receives some of the expanding gases resulting from the firing of a cartridge, and these expanding gases impinge upon a piston portion of the op rod assembly 18. Thus, the op rod assembly 18 is driven rearward (to the right in FIG. 1), away from the muzzle of the barrel by gases formed when a cartridge is fired, and is then driven forward (to the left in FIG. 1) by a return spring 22.

The forward and backward movement of the op rod assembly 18 cycles internal components, commonly referred to as the action. After a cartridge has been fired, the op rod assembly 18, which carries a firing pin 24, is forced rearward (to the right in FIG. 1) and the fired cartridge is extracted and ejected by an extractor and ejector within the bolt, as known. This movement of the op rod assembly 18 pulls on the bolt link 26, causing it to pivot and pull the bolt lock 28 up out of its cradle in the receiver 14, thereby unlocking the bolt 30 from the receiver 14. Once free from the mating receiver surfaces, the bolt 30 travels rearwardly with the bolt link 26 and op rod assembly 18, and the op rod assembly 18 contacts a buffer in the buttstock, halting its rearward movement, and immediately begins return travel in response to the compression of the return spring 22. The return spring 22 then forces the op rod assembly 18 forward (to the left in FIG. 1). During forward movement, a fresh cartridge is stripped from a belt or magazine or the like (in accordance with the type of cartridge loading mechanism associated with the rifle 10) and chambered, and the bolt 30 moves until the cartridge is seated, which limits the forward movement of the bolt 30 so that the bolt link 26 is caused to rotate downwardly, lowering the bolt lock 28 into locking engagement with the receiver, at which stage, the bolt 30 cannot move rearwardly. Directly thereafter, the firing pin 24 carried by the op rod assembly 18 is forced to strike the primer of the chambered cartridge, thereby firing it, whereby the above firing sequence is repeated so long as the sear associated with the trigger 34 remains out of the path of a sear ledge machined into the op rod assembly 18. In this embodiment, a belt feed and associated roller mechanism is employed to feed rounds into the receiver, as is known for the M240. The sear remains out of the path of the sear ledge so long as the trigger 34 remains depressed, but extends into the path of the sear ledge to catch and hold the op rod assembly 18 from further cycling when the trigger 34 is released. A buttstock (not shown) is provided rearwardly of the trigger housing (to the right in FIG. 1), and allows shoulder firing of the rifle, as is conventional with all styles and types of rifles.

Thus, the original M240 Rifle is provided with a striking mechanism for fully automatic operation. Private ownership of such firearms is restricted by federal law to Class II and III Firearms Dealers and those citizens who apply for and obtain the requisite permission from the local authority where they reside and the Bureau of Alcohol, Tobacco, Firearms and Explosives (BATFE) to become the registered owner of a NFA (National Firearms Act) firearm. By converting the fully automatic fire rifle to permanent semi-automatic operation, the rifle can be owned by qualified and approved citizens without registration as an NFA firearm.

Figure 2:
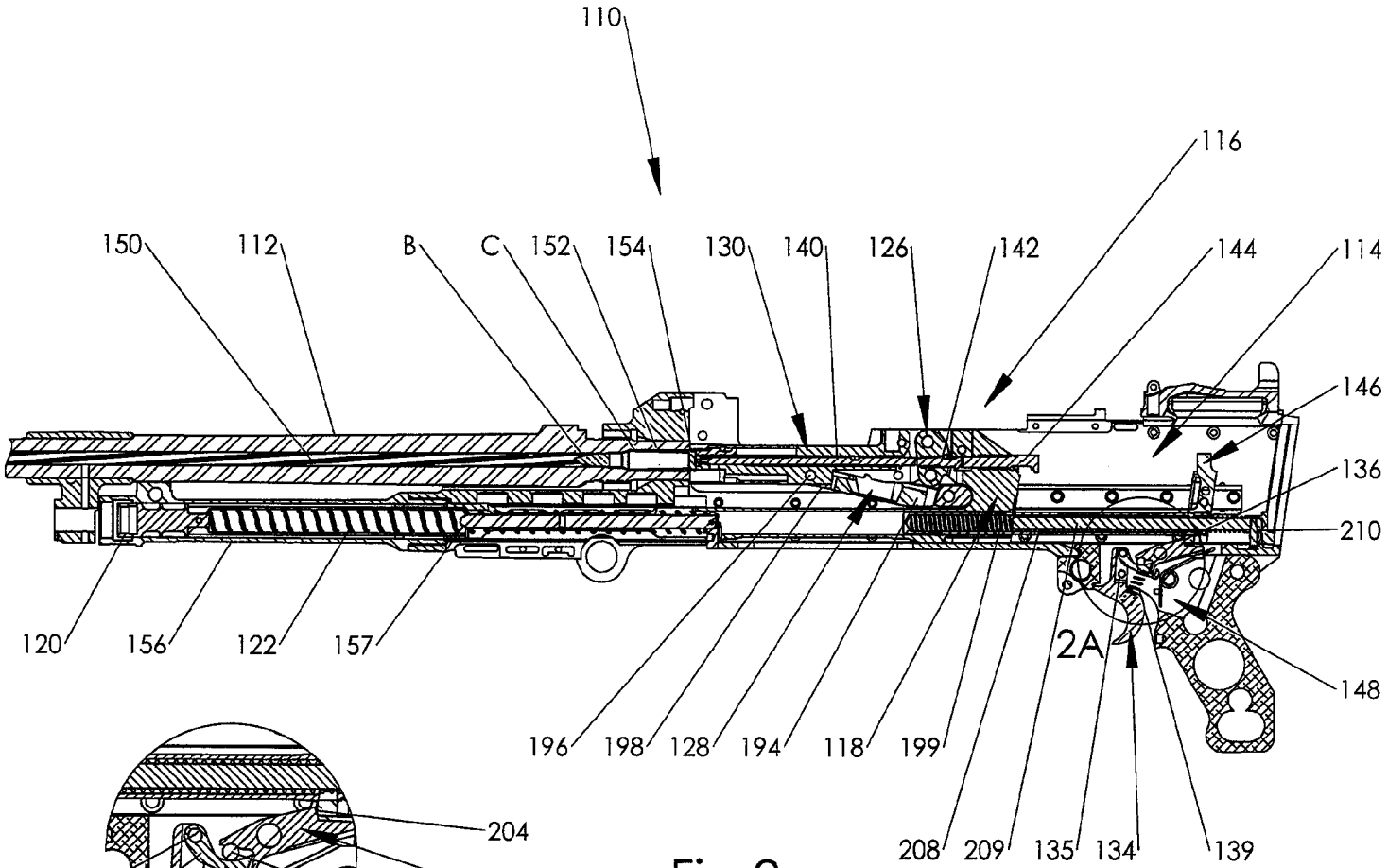
FIG. 2 is a side elevation view in partial cross section showing a portion of a semi-automatic rifle in accordance with this invention, shown ready to be fired.
Figure 2A:
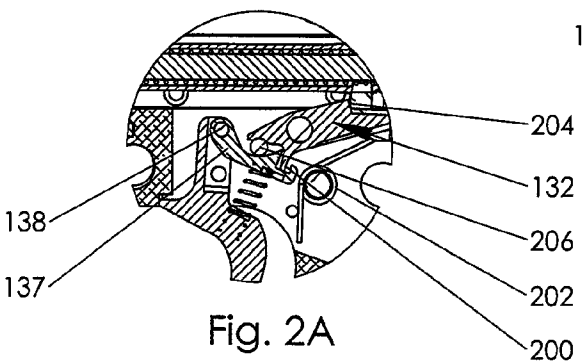
FIG. 2A is a close up of the region identified in FIG. 2 as "2A"

The present invention provides such a conversion by the means of a novel striking mechanism, as depicted in FIG. 2 and indicated generally by the numeral 116. For this striking mechanism 116, the bolt 30, bolt link 26 and op rod assembly 18 are converted to a new form, and an additional linear hammer mechanism is provided to work in association with those converted elements to provide for semi-automatic firing. The rifle with this striking mechanism is designated by the numeral 110 to indicate that although it is similar to the rifle 10, it is a converted rifle 110 capable of only semi-automatic fire in accordance with this invention. It will be appreciated that, where applicable, similar numbers have been employed, though increased by 100, to indicate that elements are similar to those in rifle 10, though perhaps converted per this invention.

Figure 5:
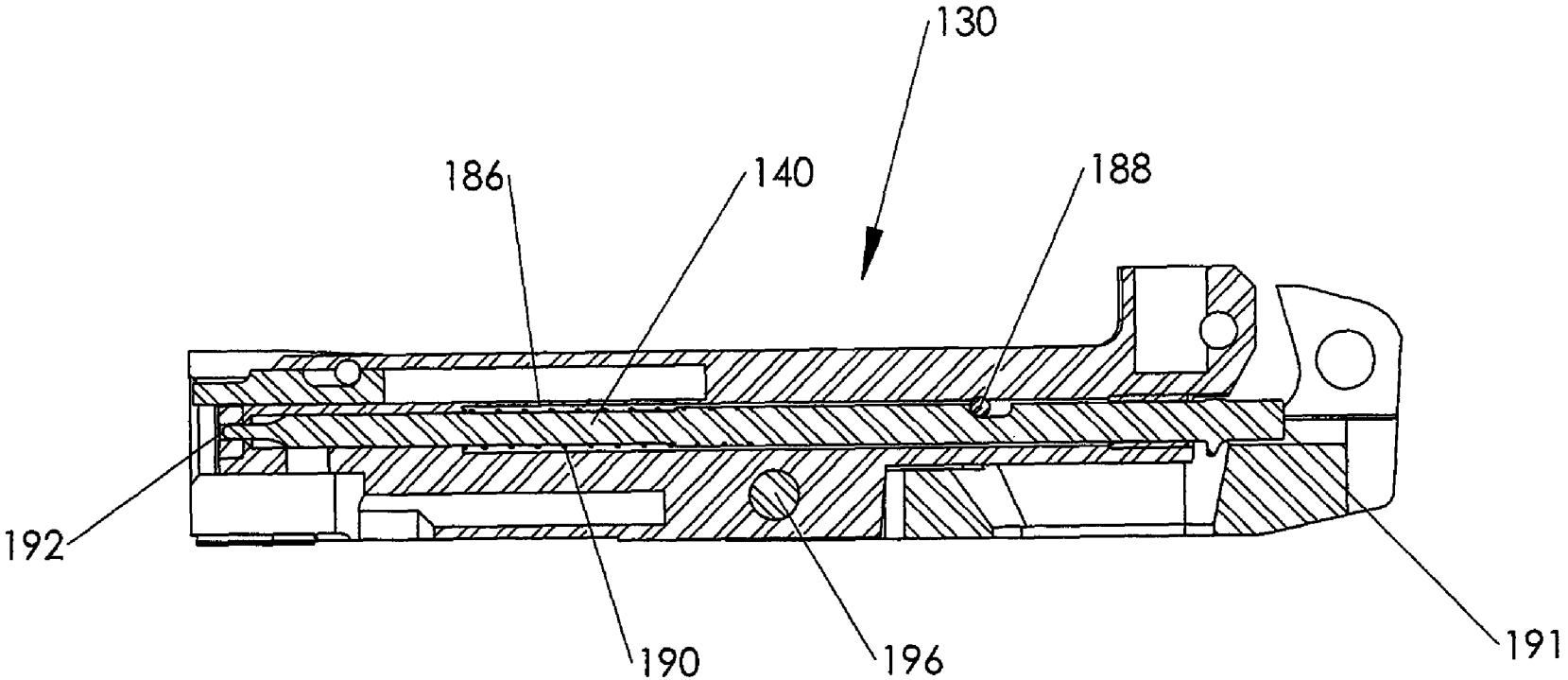
FIG. 5 is a side elevation cross sectional view of a bolt in accordance with this invention.
Figure 6:
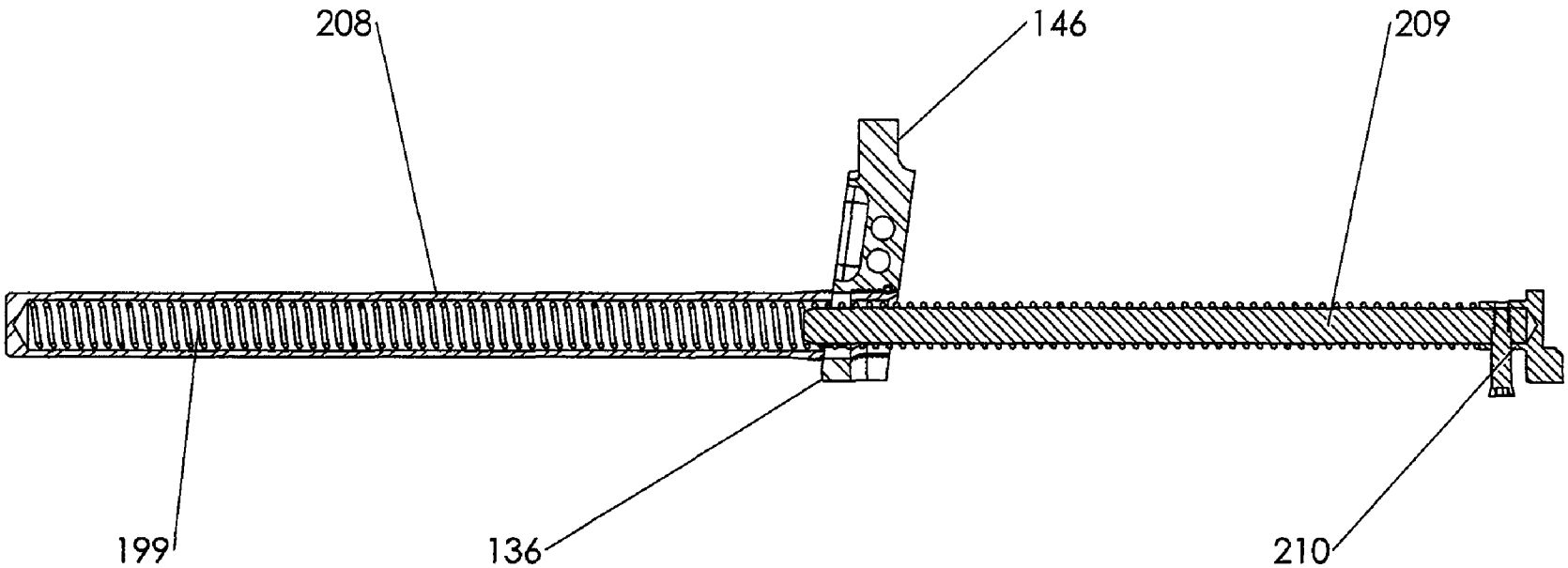
FIG. 6 is a side elevation cross sectional view of a linear hammer in accordance with this invention.

The striking mechanism 116 includes a bolt 130 (FIG. 5), which houses a primary firing pin 140; a bolt lock 128; a bolt link assembly 126 (FIG. 4), which houses a bolt link transfer pin 142; an op rod assembly 118 (FIG. 3), which houses an op rod transfer pin 144; and a linear hammer 146 (FIG. 6). This striking mechanism 116 is housed within the receiver 114, which is preferably machined to accept it but not to accept the original striking mechanism elements, and, accordingly, the rifle 110 is not readily convertible back to fully automatic fire. The striking mechanism 116 is cycled by movements of the op rod assembly 118 and the linear hammer 146, as will be described in greater detail herein below, and is activated by a cocking mechanism and a trigger assembly. The trigger assembly is indicated generally by the numeral 148, and is a replacement for the trigger assembly providing the trigger 34 and sear of the fully automatic rifle 10. The trigger assembly 148 interacts with the linear hammer 146 to effect the semi-automatic firing disclosed herein.

Before proceeding with a detailed description of the striking mechanism 116, a general discussion pertaining to the interaction of the other components will be useful. With reference to FIG. 2, the barrel 112 provides a rifled bore 150 and a chamber 152 at the end or breach 154, for receipt of a cartridge C. The breach 154 is typically threaded into the front of the receiver 114. Immediately below the barrel 112, a gas cylinder 156 conducts spent gases from firing of the cartridge C against the gas piston 120, which is connected to and thus part of the op rod assembly 118. The gas piston 120 is hollow and houses the return spring 122 which is mounted on a return spring guide rod 157, rigidly carried by a catch in the receiver 114. The return spring 122 is compressed after a cartridge is fired and this compression provides the energy to return the op rod assembly 118 back to the closed bolt position at which it can serve to fire another cartridge.

Figures 3, 3A:
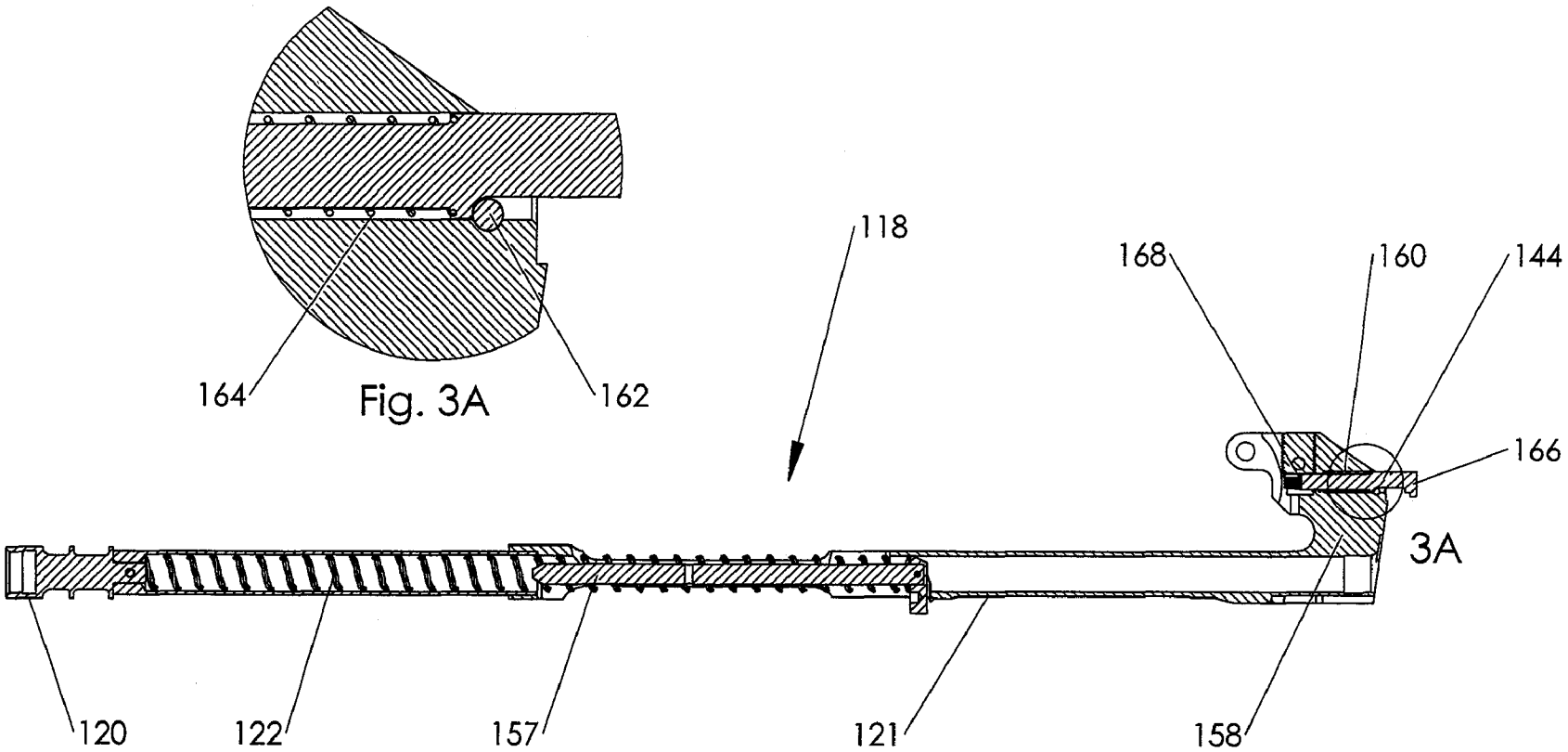
FIG. 3 is a side elevation of an op rod assembly in accordance with this invention shown in partial cross sectional.
FIG. 3A is a close up of the region identified in FIG. 3 as "3A"

With reference to FIG. 3 it can be seen that the op rod assembly 118 includes a rear body portion 158 that extends upwardly from a hollow op rod portion 121. The rear body portion 158 includes a through bore 160 for receipt of the op rod transfer pin 144, which is held within the through bore 160 by a pin 162. A compression spring 164 encircles the forward portion of the op rod transfer pin 144 within the bore 160 to bias it rearwardly and place the contact end 166 thereof outside of the rear body portion 158, at rest. The op rod transfer pin 144 can be driven forwardly through the body 158 so that its striking end 168 emerges from the through bore 160, and, after the driving force is removed, the spring 164 will return it to rest.

Figure 4:
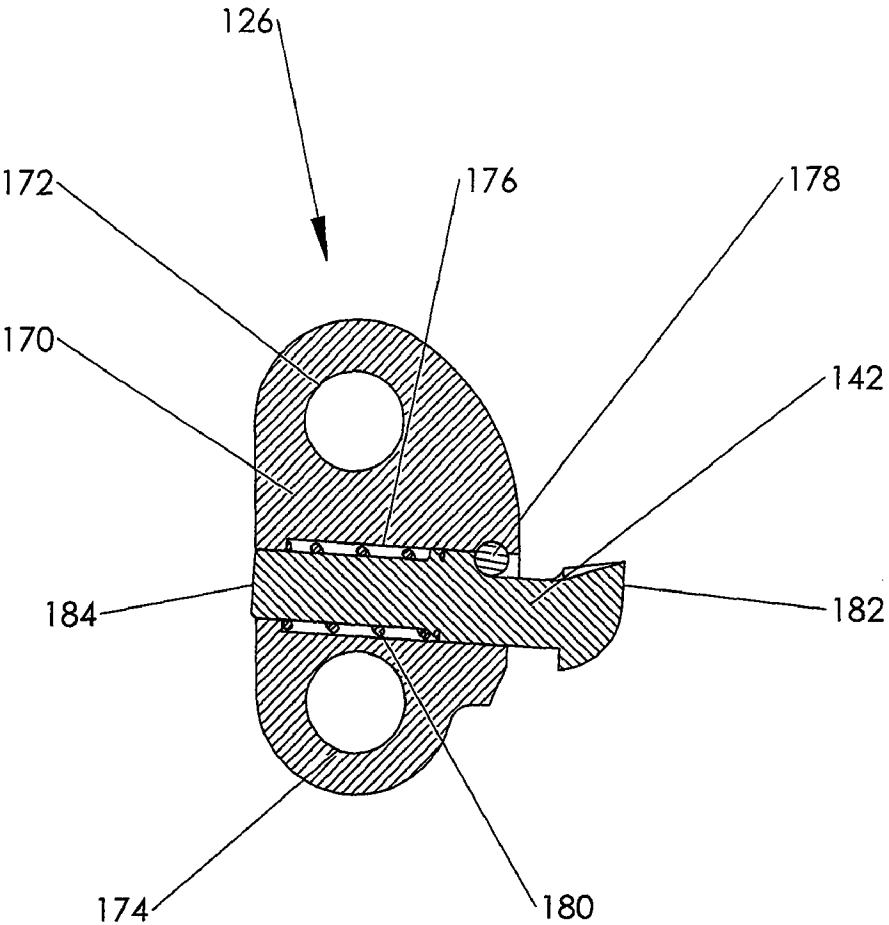
FIG. 4 is a side elevation cross sectional view of a bolt link assembly in accordance with this invention.

Similarly, with reference to FIG. 4, the bolt link assembly 126 includes a body 170 connected to the op rod assembly 118 by a pin 172 at a top portion thereof and connected to the bolt lock 128 by a pin 174 at a bottom portion thereof. The body 170 includes a through bore 176 for receipt of the bolt link transfer pin 142, which is held within the through bore 176 by a pin 178. A compression spring 180 encircles the forward portion of the bolt link transfer pin 142 within the bore 176 to bias it rearwardly and place the contact end 182 thereof outside of the body 170, at rest. The bolt link transfer pin 142 can be driven through the body 170 so that its striking end 184 emerges from the through bore 176, and after the driving force is removed, the spring 180 will return it to rest.

With reference to FIG. 5, the bolt 130 carries the primary firing pin 140, which is held in a through bore 186 and moves relative thereto by a pin 188 and a compression spring 190. Thus, the contact end 191 of the primary firing pin 140 is biased rearwardly, at rest, and can be contacted to drive striking end 192 of the primary firing pin 140 into the primer of a chambered cartridge C.

As best depicted in FIG. 2, the bolt lock 128 assumes a kneeling position when it and the bolt 130 are locked in battery. The rear end 194 of the bolt lock 128 is secured to the bolt link assembly 126 by the pin 174 (FIG. 4), and the bolt lock 128 extends upwardly at an angle to connect to the bolt 130 by a pin 196 at the front of the bolt lock 128. As the op rod assembly 118 travels backward toward the buttstock, the bolt link assembly 126 is pulled rearwardly, and the bolt lock 128 is thereby pulled upwardly and rearwardly due to its connection to the bold link assembly 126 at pin 174. This design was customary with the original M240 and is employed in the striking mechanism 116 of the present invention.

In order to cycle the action without firing, for loading and clearing, a cocking slide provides a handle at the right side of the receiver 114. The cocking slide reciprocates within a longitudinal recess cut into the receiver 114. A stop at the forward edge of the recess defines a rest or home position for the cocking slide. The slide carries a lug on its inner side that is engageable with the op rod assembly 118 such that pulling rearwardly on the handle draws the op rod assembly 118 rearwardly. The initial movement of components causes the bolt link assembly 126 to rotate, drawing the bolt lock 128 upwardly to unlock the bolt 130. Subsequently, the bolt 130 is moved rearwardly and extracts any cartridge within the chamber. The movement of the op rod assembly 118 pushes the linear hammer 146 rearwardly. When pulled far enough, a sear ledge 136 machined on the bottom of the linear hammer 146 catches on the sear 132 of the trigger assembly 148. As the bolt 130 is allowed to move forwardly, due to the return spring 122, it strips another round, and eventually closes on the chamber 152, while the linear hammer 146 remains held back by the interaction of the sear 132 and sear ledge 136 and is under tension to move forwardly by the action of a hammer spring 199.

With reference again to FIG. 2, the trigger assembly 148 shall be described next. As with many of the components of the rifle, the striking mechanism 116 is not designed to operate with the original trigger mechanism of the M240 Rifle, which did not include a linear hammer. The trigger assembly of the M240 Rifle is thus modified or replaced with a trigger mechanism 148.

The trigger assembly 148 includes a trigger 134 that is pivotally carried on a pin 135. The crescent portion of the trigger 134 is below the pivot point established by the pin 135, but the body of the trigger 134 extends above that pivot point to interact with a disconnector 137 pivotally secured to the trigger 134 by a pin 138. The disconnector 137 is biased by a compression spring 139 to engage a latch end 200 of the sear 132, which is itself biased for limited rotational movement by a torsion spring 202. With reference to FIGS. 2 and 6, the sear 132 provides a tip 204 that engages the sear ledge 136 of the linear hammer 146, when cocked back as already described above. The linear hammer 146 is biased by a hammer spring 199 mounted on a spring rod 209 and compressed between the closed end of a hollow hammer tube 208 and the mount 210 for the spring rod 209 located proximate the buttstock. Thus, the linear hammer 146 is biased in a direction against the tip 204 of the sear 132, and, when the tip 204 of the sear is released from the sear ledge 136 of the hammer by squeezing the trigger 134, the linear hammer 146 will travel toward the op rod assembly 118 under the influence of the hammer spring 199.

More particularly, when the trigger 134 is squeezed, the disconnector 137 is pulled at pin 138 forwardly against cam 206, thus forcing the disconnector 137 to also move downwardly against the compression spring 139. The forward movement causes the disconnector 137 to pull on the latch end 200 of the sear 132, thus causing the sear 132 to pivot and its tip 204 to disconnect from the sear ledge 136, thus leading to the firing of the cartridge. At substantially the same time, the disconnector 137 disconnects from the sear 132, thus permitting the sear 132 to move independent of the trigger 134 under the influence of torsion spring 202 to catch the sear ledge 136 as it travels back under the influence of the expanding gases from the firing of the cartridge as already disclosed.

Figure 7:
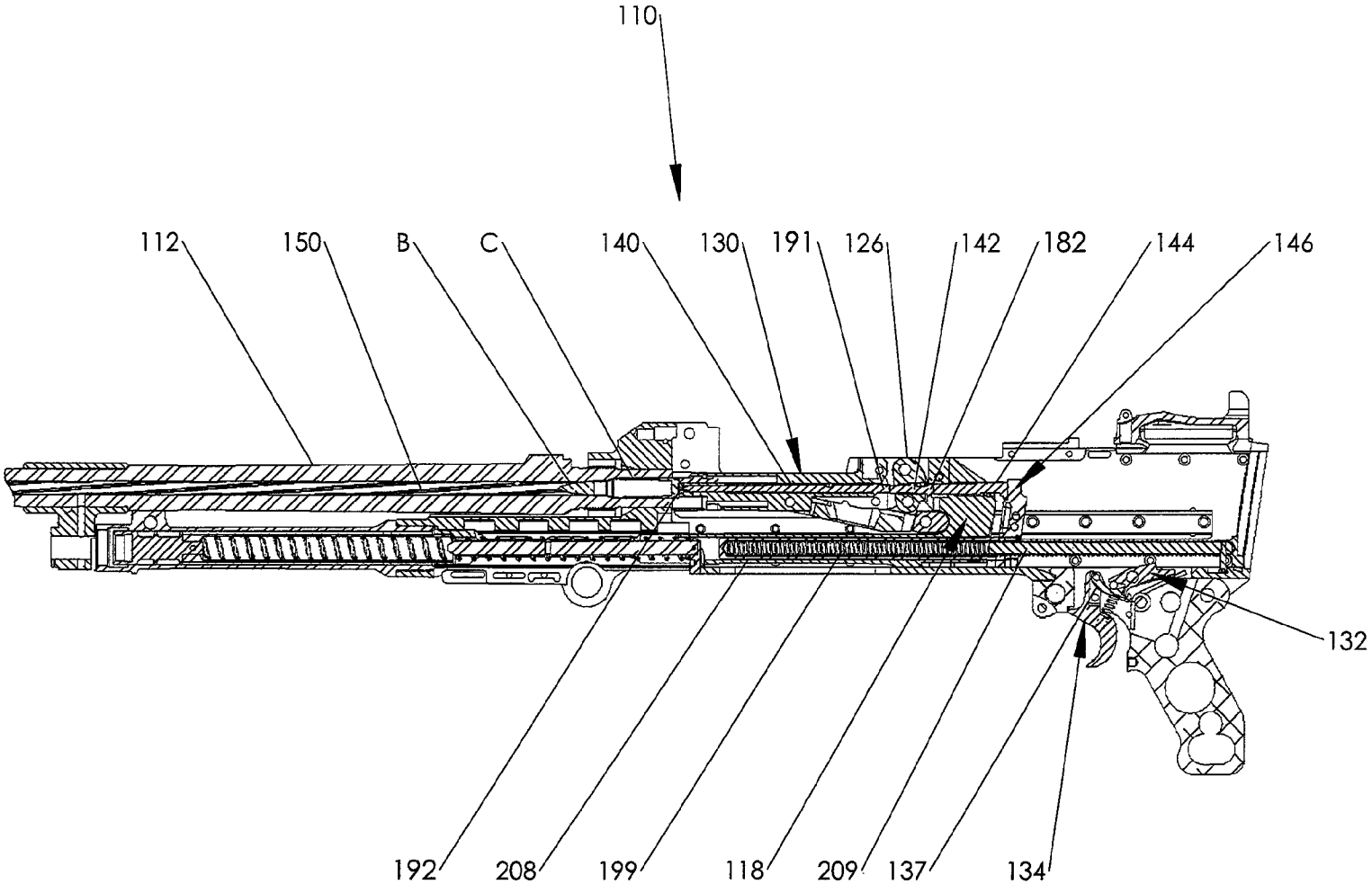
FIG. 7 is a side elevation as in FIG. 2, shown when the linear hammer has been released to contact other striking mechanisms for striking a cartridge held in battery.

Firing the rifle can be viewed with reference to FIGS. 2 and 7. In FIG. 2, relevant components of the rifle 110 are shown in position ready for semi-automatic firing of cartridges C. The op rod assembly 118 is pulled forwardly by the return spring 122, and the bolt lock 128 and bolt 130 assume their positions locked in battery, with a cartridge C in position for firing. The bolt link assembly 126 is pivoted to a position placing the striking end 184 of the bolt link transfer pin 142 in close proximity to the contact end 191 of the primary firing pin 140, and placing the contact end 182 of the bolt link transfer pin 142 in close proximity to the striking end 168 of the op rod transfer pin 144. Preferably, the op rod transfer pin 144, bolt link transfer pin 142 and primary firing pin 140 are all in alignment, as shown, as this will transfer force most efficiently through the pins to impact the primer of the cartridge C. The contact ends 190, 182, and 166 of all pins 140, 142, and 144 are in their rest positions. A sear ledge 136 of the linear hammer 146 is held by the sear 132 of the trigger assembly 148, and the hammer spring 199 is compressed between the closed end of the hammer tube 208 and the mount 210. Thus, the loaded position of the rifle, prior to firing, is depicted in FIG. 2.

As the trigger 134 is pulled, the linear hammer 146 is released and slides forwardly in the direction of the op rod assembly 118. As seen in FIG. 7, the linear hammer 146 strikes the contact end 166 of the op rod transfer pin 144, thus causing its striking end 168 to strike the contact end 182 of the bolt link transfer pin 142 and force the striking end 184 thereof into the contact end 191 of the primary firing pin 140. This likewise forces the striking end 192 of the primary firing pin 140 into the primer of the chambered cartridge C to fire the bullet B.

Immediately thereafter, the gases are partially expelled into the gas cylinder156 to impact the gas piston 120 and initiate rearward movement of the op rod assembly 118. This also moves the linear hammer 146 rearwardly, because it abuts the rear portion of the op rod assembly 118. As the op rod assembly 118 travels rearwardly, the bolt link assembly 126 rotates, pulling the bolt lock 128 upwardly to unlock the bolt 130. Because the bolt link assembly 126 pivots and all transfer pins and the primary firing pin 140 are thus no longer in contact, the primary firing pin 140 and the bolt link transfer pin 142 assume their extended rest positions relative to their respective through bores 186 and 176 due to the influence of the springs 190 and 180. The op rod transfer pin 144 remains in its fired position due to the contact of the linear hammer 146 with the contact end 166. Continued rearward movement of the op rod assembly 118 and linear hammer 146 brings the sear ledge 136 of the linear hammer 146 into contact with the sear 132 of the trigger assembly 148, such that the linear hammer 146 remains held in the ready fire position of FIG. 2, while the op rod assembly 118 and connected bolt link assembly 126, bolt lock 128, and bolt 130 elements are forced back to their ready fire positions by return spring 122. Notably, once the linear hammer 146 is caught by the sear 132 and removed from contact with the contact end 166 of the op rod transfer pin 144, the op rod transfer pin 144 assumes its extended rest position relative to its through bore 160 due to the influence of the spring 164. Thus, the position of FIG. 2 is reassumed, and a subsequent pulling of the trigger will fire another round. It should be mentioned that, during rearward travel, the empty cartridge case is ejected from the rifle, and during the return forward travel, a new cartridge is stripped from the belt for chambering.

Figure 8:
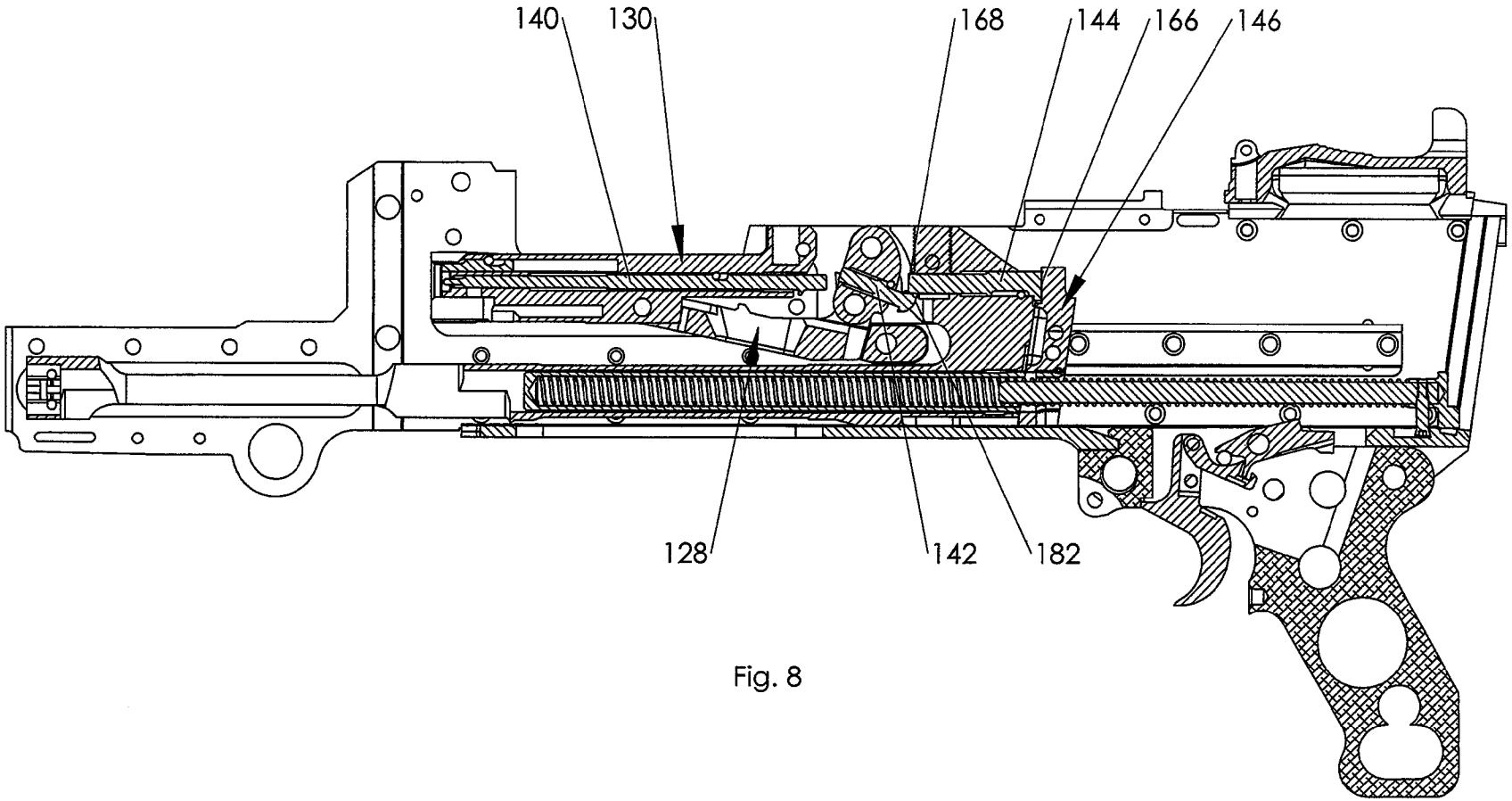
FIG. 8 is a side elevation as in FIG. 7, showing a safety feature whereby the rifle of this invention is not easily converted back to fully automatic operation due to the interference of the movement of the bolt link transfer pin.

If there has been any attempt to alter the engagement of the sear 132 and sear ledge 136, or should the same break or wear, the linear hammer 146 may not lock in the ready fire position of FIG. 2, and it may instead follow the op rod assembly 118 under the influence of hammer spring 199. However, this will not result in a fully automatic operation in light of safety features worked into the design. More particularly, as seen in FIG. 8, with the linear hammer 146 following the op rod assembly 118, it remains in contact with the contact end 166 of the op rod transfer pin 144, forcing it to its extended position. This places the striking end 168 of the op rod transfer pin 144 in the circumferential path of the contact end 182 of the bolt link transfer pin 142 as it begins to rotate downwardly once the bolt 130 and bolt lock 128 are seated. The contact end 182 of the bolt link transfer pin 142 contacts the underside of the op rod transfer pin 144, and is thereby prevented from aligning between the primary firing pin 140 and op rod transfer pin 144 as is necessary in order to cause the transfer of striking force necessary to strike the primer of the chambered cartridge. Thus, should the sear 132 or sear ledge 136 be altered for the purpose of converting back to fully automatic operation, the linear hammer 146 follows the op rod assembly 118 and associated components and prevents the alignment of the pins that is necessary for the firing of a bullet, thus preventing fully automatic operation. Furthermore, the action cannot be re-cocked because the linear hammer 146 cannot be locked in a pre-strike or cocked position and thus, semi-automatic operation is also disabled. To return the rifle to operation, the component(s) improperly modified or worn will have to be fixed or replaced, and, thus, the rifle is not capable of being reconverted to fully automatic operation.

The method of the present invention for converting the full automatic action of the M240 Rifle, or similar firing firearms to semi-automatic operation involves the steps of converting the bolt, the bolt link, and the op rod assembly to carry transfer and firing pins as disclosed, and further involves associating a linear hammer with the op rod assembly. The trigger assembly is also converted. Particularly, where the bolt and bolt link of the fully automatic M240 simply permitted the passage of the primary firing pin carried by the op rod assembly, they must now provide their own spring-biased primary firing pin and bolt link transfer pin. The op rod assembly must be converted to provide a shorter pin, here called the op rod transfer pin, to interact with the converted bolt link transfer pin and primary firing pin. The op rod transfer pin is also preferably designed to block the alignment of the bolt link transfer pin with the op rod transfer pin and primary firing pin, as disclosed above, when the op rod transfer pin is contacted by the linear hammer during a forward cycling of the op rod assembly As should be apparent from the foregoing description, the original fully automatic rifle 10 is converted to the semi-automatic rifle 110 by the conversion of striking mechanism elements and trigger mechanism elements. While it is desirable to provide a receiver that will operate with the original barrel design, gas tube, buttstock and internal components, such as the bolt lock, in the preferred embodiment, the receiver is altered sufficiently so as to no longer accommodate the original components that allowed fully automatic operation. In this manner, BATFE regulations are satisfied because the rifle cannot readily be converted back to fully automatic operation merely by acquiring and re-installing the original components.

Components that can be readily remanufactured to work with the striking mechanism of the present invention include the receiver and the op rod assembly. Making the receiver narrower internally than the original design will readily prohibit the reintroduction of original components, as will moving several of the slots, bores and recesses for assembly and movement of internal component parts. Use of a different op rod assembly will also inhibit restoration of the fully automatic action. Moreover, the use of the novel striking mechanism 116 ensures that the semi-automatic firearm cannot be readily modified to allow fully automatic operation of the firearm.

Thus it should be evident that the striking mechanism 116 and trigger assembly 148 of the present invention are useful for providing a semi-automatic firearm. The invention is particularly suited and has been reduced to practice for conversion of the M240 Rifle, but is not necessarily limited thereto. Similarly, the striking mechanism and trigger assembly of the present invention can be used with existing components of automatic firearms as well as with modifications thereof. In addition, the methods of the present invention allow the conversion of fully automatic firearms to semi-automatic operation. The methods also can be employed for the permanent conversion of fully automatic firearms to semi-automatic operation. By modifying the sizes of more of the components of the original automatic firearm, such as, for instance the receiver and the op rod assembly, restoration of the fully automatic action will also be more completely inhibited.

Based upon the foregoing disclosure, it should now be apparent that the present invention provides advances in the art by providing means for converting a fully automatic firearm to semi-automatic operation and inhibiting conversion thereof back to fully automatic operation. Notably, the structures of the present invention are not limited to rifle conversion and could be employed in the manufacture of wholly new firearms. It is, therefore, to be understood that any variations evident fall within the scope of the claimed invention and thus, the selection of specific component elements can be determined without departing from the spirit of the invention herein disclosed and described. Thus, the scope of the invention shall include all modifications and variations that may fall within the scope of the attached claims.

What is claimed is:

1. A striking mechanism for the semi-automatic operation of a cartridge firing firearm comprising:

a receiver;

a barrel attached to said receiver and providing a breach;

a bolt adapted for reciprocating movement within said receiver and engageable with said breach of said barrel and the face of a cartridge chambered therein, the bolt carrying a primary firing pin;

bolt lock means pivotally connected to said bolt for selectively locking said bolt within said receiver;

an op rod assembly;

a bolt link assembly pivotally connected to said bolt lock means and to said op rod assembly, said bolt link assembly providing a bolt link transfer pin;

an op rod transfer pin carried by said op rod assembly and engageable with said bolt link transfer pin;

a linear hammer engageable with said op rod transfer pin such that, when a cartridge is chambered and said primary firing pin, said bolt link transfer pin and said op rod transfer pin are in alignment, a force of said linear hammer engaging said op rod transfer pin is transferred through said op rod transfer pin, said bolt link transfer pin and said primary firing pin to strike a primer of a cartridge chambered within the barrel and thereby fire the cartridge.

2. The striking mechanism of claim 1, wherein said op rod assembly includes a gas piston portion, and expanding gases from the firing of a cartridge are transferred to impact said gas piston portion and drive said op rod assembly rearwardly, away from said breach, said linear hammer being positioned behind said op rod assembly such that the rearward movement of the op rod assembly also drives said linear hammer rearwardly.

3. The striking mechanism as in claim 2, further comprising a trigger assembly including a sear, wherein said linear hammer includes a sear ledge intended to engage said sear during proper operation.

4. The striking mechanism of claim 3, wherein said bolt carries a spring that biases said primary firing pin rearwardly relative to said breach.

5. The striking mechanism of claim 4, wherein said bolt link carries a spring that biases said bolt link transfer pin rearwardly.

6. The striking mechanism of claim 5, wherein said op rod assembly carries a spring that biases said op rod transfer pin rearwardly.

7. The striking mechanism of claim 6, wherein, after firing a cartridge, said op rod assembly and said linear hammer are forced to move rearwardly, and said linear hammer remains engaged with said op rod transfer pin until the rearward movement of said op rod assembly and said linear hammer causes said sear ledge of said linear hammer to engage said sear of said trigger assembly and hold the linear hammer from further movement, said op rod assembly thereafter travelling forwardly and thereby distancing said op rod transfer pin from said linear hammer, wherein, while said linear hammer remains engaged with said op rod transfer pin, said op rod transfer pin cannot move rearwardly under the influence of said spring carried by said op rod assembly, and, when said linear hammer is distanced from said op rod transfer pin, said op rod transfer pin is moved rearwardly by said spring carried by said op rod assembly.

8. The striking mechanism of claim 7, wherein, as said op rod assembly and said linear hammer are forced to move rearwardly after the firing of a cartridge, the rearward movement of said op rod assembly causes said bolt link assembly to pivot in a first direction, and the bolt link transfer pin travels in a circumferential path out of alignment with said op rod transfer pin and said primary firing pin, and, as the op rod assembly travels forwardly, said bolt link assembly pivots in a second, opposite direction, and the bolt link transfer pin travels in a circumferential path back toward alignment with said op rod transfer pin and said primary firing pin.

9. The striking mechanism of claim 8, wherein, if said sear ledge of said linear hammer fails to engage said sear of said trigger assembly after rearward movement of said op rod assembly and said linear hammer, said linear hammer follows said op rod assembly in its forward travel and remains engaged with said op rod transfer pin, preventing it from moving rearwardly under the influence of said spring carried by said op rod transfer pin, and said bolt link transfer pin contacts said op rod transfer pin and is prevented from aligning with said op rod transfer pin and said primary firing pin, thus preventing firing of a cartridge.

10. A method for converting a cartridge firing firearm from fully automatic operation to semi-automatic operation, wherein the cartridge firing firearm of fully automatic operation provides a receiver; a barrel attached to the receiver, the barrel providing a breach; a bolt reciprocable within the receiver, the bolt being engageable with the breach of the barrel and a face of a cartridge chambered therein; a bolt lock pivotally connected to the bolt for selectively locking the bolt within the receiver; an op rod assembly movable within the receiver and providing a sear ledge and carrying a firing pin; a bolt link pivotally connected to the bolt lock and to the op rod assembly and permitting passage of the firing pin through the bolt link; and a trigger assembly including a sear engagable with the sear ledge on the op rod assembly, the method comprising:

replacing the bolt with a converted bolt providing a primary firing pin;

replacing the bolt link with a converted bolt link providing a bolt link transfer pin;

replacing the op rod assembly with a converted op rod assembly with no sear ledge such that the op rod assembly does not catch on the sear, the converted op rod assembly providing an op rod transfer pin; and providing a linear hammer having a sear ledge for interaction with the sear of the trigger assembly, the linear hammer being urged toward the op rod assembly by a hammer spring.

* * * * *